US005810886A

United States Patent [19]

Hassan

[11] Patent Number: 5,810,886

[45] Date of Patent: Sep. 22, 1998

[54] DISPENSING PACIFIER APPARATUS

[76] Inventor: Hussein Hassan, 72-16 51st Dr., Woodside, N.Y. 11377

[21] Appl. No.: 707,311

[22] Filed: Sep. 3, 1996

[51] Int. Cl.[6] ..... A61J 17/00; A61J 7/00

[52] U.S. Cl. ..... 606/234; 215/11.1; 606/236

[58] Field of Search ..... 606/236, 234–235; 215/11.1–11.6; 604/77

[56] References Cited

U.S. PATENT DOCUMENTS

| | | | |
|---|---|---|---|
| 4,192,307 | 3/1980 | Baer . | |
| 4,324,249 | 4/1982 | Sundkvist | 606/236 |
| 4,481,949 | 11/1984 | Kesselring et al. . | |
| 4,715,379 | 12/1987 | McCormick | 606/234 |
| 5,013,321 | 5/1991 | MacVane | 606/234 |
| 5,078,734 | 1/1992 | Noble | 606/234 |
| 5,123,915 | 6/1992 | Miller et al. . | |
| 5,129,532 | 7/1992 | Martin . | |
| 5,176,705 | 1/1993 | Noble . | |
| 5,300,024 | 4/1994 | Yang | 606/234 |
| 5,300,089 | 4/1994 | Sassin | 606/236 |
| 5,431,680 | 7/1995 | Jones | 606/234 |
| 5,512,047 | 4/1996 | Dvorack | 604/77 |

*Primary Examiner*—Michael Buiz
*Assistant Examiner*—Nancy Connolly Mulcare

[57] ABSTRACT

A dispensing pacifier apparatus includes a dispenser assembly which includes a flexible container portion and a screw cap assembly which is removably connected to the flexible container portion. The flexible container portion includes a loading end and a dispensing end. The loading end receives the screw cap assembly, and the dispensing end includes one or more dispensing channels. A guard assembly is connected to the dispenser assembly and includes a perimeter portion which surrounds the dispenser assembly. The guard assembly is connected to the dispenser assembly adjacent to the loading end of the flexible container portion in a position below the screw cap assembly. The guard assembly includes a front side and a rear side. A plurality of saliva-absorbent apertures are located on the front side of the guard assembly. The guard assembly includes a top portion and a bottom portion, and a greater density of saliva-absorbent apertures are located on the bottom portion than the top portion. The screw cap assembly includes a cap which may be a child-proof cap. The screw cap assembly includes an extension portion connected to the cap. The extension portion of the screw cap assembly includes a connection aperture. The flexible container portion may be made of transparent material so that material contained within the flexible container portion is visible from outside the flexible container portion. The flexible container portion includes indicia indicative of volume of material inside the flexible container portion.

8 Claims, 2 Drawing Sheets

10
26
30
34
16
19
17
28
40
42
12
20
28
22
12
28
24
14
36

32
10
14
36
28
17
16
24
19
42
18
34

DISPENSING PACIFIER APPARATUS

BACKGROUND OF THE INVENTION

1. Field of the Invention

The present invention relates generally to pacifiers used for infants and, more particularly, to pacifiers especially adapted for dispensing food or medicinal materials.

2. Description of the Prior Art

Pacifiers are well known articles used in infant care. A pacifier gives an infant an opportunity to carry out a natural desire to suckle. Throughout the years, a number of innovations have been developed relating to pacifiers to use the infant's natural desire to suckle for dispensing food or medicinal materials, and the following U.S. patents are representative of some of those innovations: U.S. Pat. Nos. 4,192,307; 5,078,734; 5,123,915; 5,129,532; and 5,176,705. More specifically, U.S. Pat. No. 4,192,307 discloses a pacifier with a sweets dispensing nipple. The nipple is sealed with simple friction fit which can relatively easily become unsealed if the infant plays with the pacifier. In this respect, it would be desirable if a dispensing pacifier were provided which avoids the use of a simple friction fit for sealing the nipple portion of the pacifier.

Each of U.S. Pat. Nos. 5,078,734 and 5,123,915 discloses a medicine dispensing pacifier which includes a screw cap. There is another problem associated with an infant's using a pacifier which is not addressed by either of these patents; and that problem is dribbling saliva. When an infant sucks on a pacifier, a quantity of saliva often flows from the infant's mouth onto the infant's chin or cheek. Neither of these patents has a provision for handling such saliva. In this respect, it would be desirable if a dispensing pacifier were provided which has a provision for absorbing saliva that flows from an infant's mouth as the infant uses the pacifier.

U.S. Pat. No. 5,176,705 discloses a medication dispensing pacifier that has a screw cap. A number of holes are provided in the guard portion of the pacifier to facilitate breathing. These slots, however, are not very absorbent of saliva and unlike the present invention, this U.S. Pat. No. 5,176,705 does not teach the use of apertures of any kind or orientation for the purpose of accumulating saliva, let alone in the specific manner disclosed hereinbelow.

U.S. Pat. Nos. 4,481,949 and 5,129,532 may be of interest for their disclosure of additional nipple-employing medicine-dispensing devices.

Still other features would be desirable in a dispensing pacifier apparatus. If an infant Where to remove a cap from a pacifier dispenser, the contents of the pacifier dispenser may spill out of the dispenser. Moreover, if a cap were removed, the cap itself may be placed in the mouth of the infant, and the infant may be susceptible to choking on the cap. To avoid such possibilities, it would be desirable if a dispensing pacifier had a child-proof cap which prevents an infant from removing the cap from the dispenser.

For a pacifier dispenser, to enable an adult to ascertain how much medicine has been consumed by an infant, it would be desirable if a dispensing pacifier were provided with indicia which indicates the volume of material in the dispenser.

Thus, while the foregoing body of prior art indicates it to be well known to use a dispensing pacifier apparatus, the prior art described above does not teach or suggest a dispensing pacifier apparatus which has the following combination of desirable features: (1) avoids the use of a simple friction fit for sealing the nipple portion of the pacifier; (2) has a provision for absorbing saliva that flows from an infant's mouth as the infant uses the pacifier; (3) has provisions for effectively retaining the saliva even when the pacifier is tilted or carried in a variety of orientations; (4) prevents an infant from removing the cap from the dispenser; and (5) is provided with indicia which indicates the volume of material in the dispenser. The foregoing desired characteristics are provided by the unique dispensing pacifier apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a dispensing pacifier apparatus which includes a dispenser assembly which includes a flexible container portion and a screw cap assembly which is removably connected to the flexible container portion. The flexible container portion includes a loading end and a dispensing end. The loading end receives the screw cap assembly, and the dispensing end includes one or more dispensing channels. A guard assembly is connected to the dispenser assembly. The guard assembly includes a perimeter portion which surrounds the dispenser assembly. The guard assembly is connected to the dispenser assembly adjacent to the loading end of the flexible container portion in a position below the screw cap assembly. The guard assembly includes a front side and a rear side. The guard assembly includes a plurality of saliva-absorbent apertures located on the front side of the guard assembly. The guard assembly includes a top portion and a bottom portion, and a greater density of saliva-absorbent apertures are located on the bottom portion than the top portion.

The screw cap assembly includes a cap which is connected to the flexible container portion. The cap may be a child-proof cap. The screw cap assembly includes an extension portion connected to the cap. The extension portion of the screw cap assembly includes a connection aperture.

The flexible container portion may be made of transparent material so that material contained within the flexible container portion is visible from outside the flexible container portion. The flexible container portion includes indicia indicative of volume of material inside the flexible container portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dispensing pacifier apparatus which has all of the advantages of the prior art and none of the disadvantages.

It is another object of the present invention to provide a new and improved dispensing pacifier apparatus which may be easily and efficiently manufactured and marketed.

It is a further object of the present invention to provide a new and improved dispensing pacifier apparatus which is of durable and reliable construction.

An even further object of the present invention is to provide a new and improved dispensing pacifier apparatus which is susceptible of a low cost of manufacture with regard, to both materials and labor, and which accordingly is then susceptible of low prices of sale to the consuming public, thereby making such dispensing pacifier apparatus available to the buying public.

Still yet a further object of the present invention is to provide a new and improved dispensing pacifier apparatus which avoids the use of a simple friction fit for sealing the nipple portion of the pacifier.

Still another object of the present invention is to provide a new and improved dispensing pacifier apparatus that has a provision for absorbing saliva that flows from an infant's mouth as the infant uses the pacifier.

Yet another object of the present invention is to provide a new and improved dispensing pacifier apparatus which has provisions for effectively retaining the saliva even when the pacifier is tilted or carried in a variety of orientations.

Even another object of the present invention is to provide a new and improved dispensing pacifier apparatus that prevents an infant from removing the cap from the dispenser.

Still a further object of the present invention is to provide a new and improved dispensing pacifier apparatus which is provided with indicia which indicates the volume of material in the dispenser.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved dispensing pacifier apparatus embodying the principles and concepts of the present invention will be described.

Figure 1:
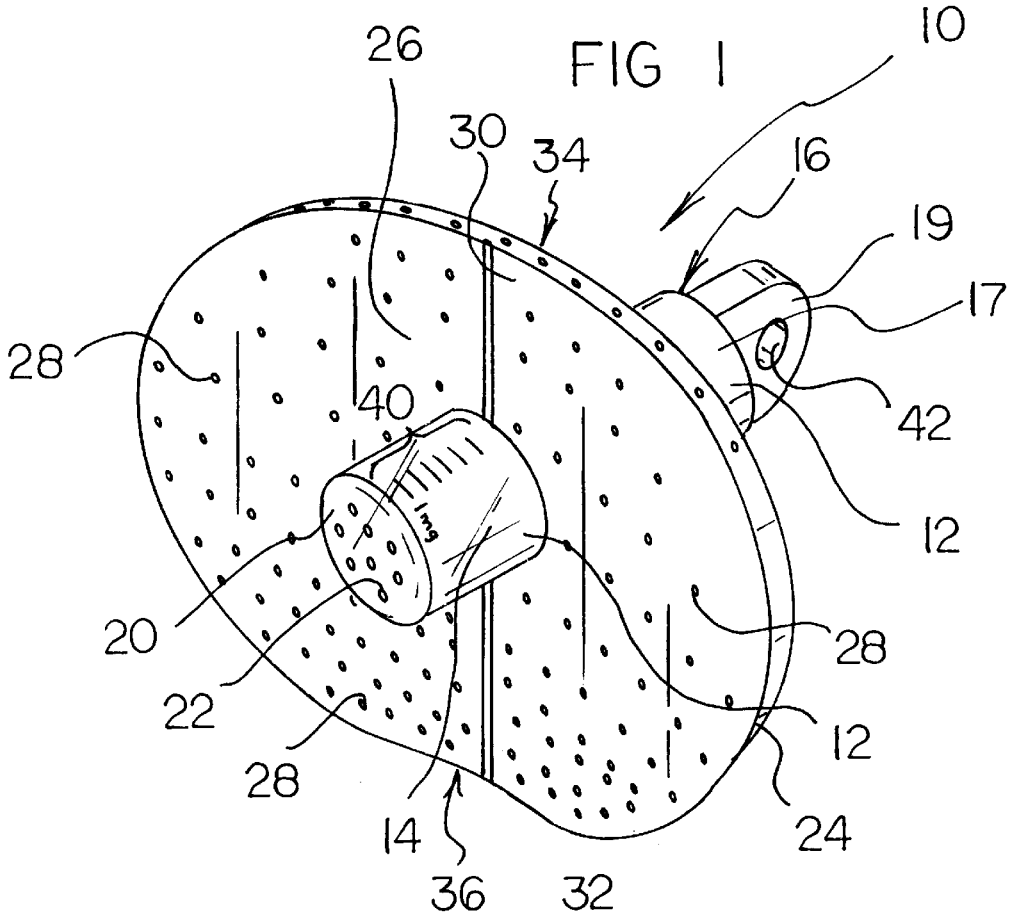
FIG. 1 is a top front perspective view showing a preferred embodiment of the dispensing pacifier apparatus of the invention.
Figure 2:
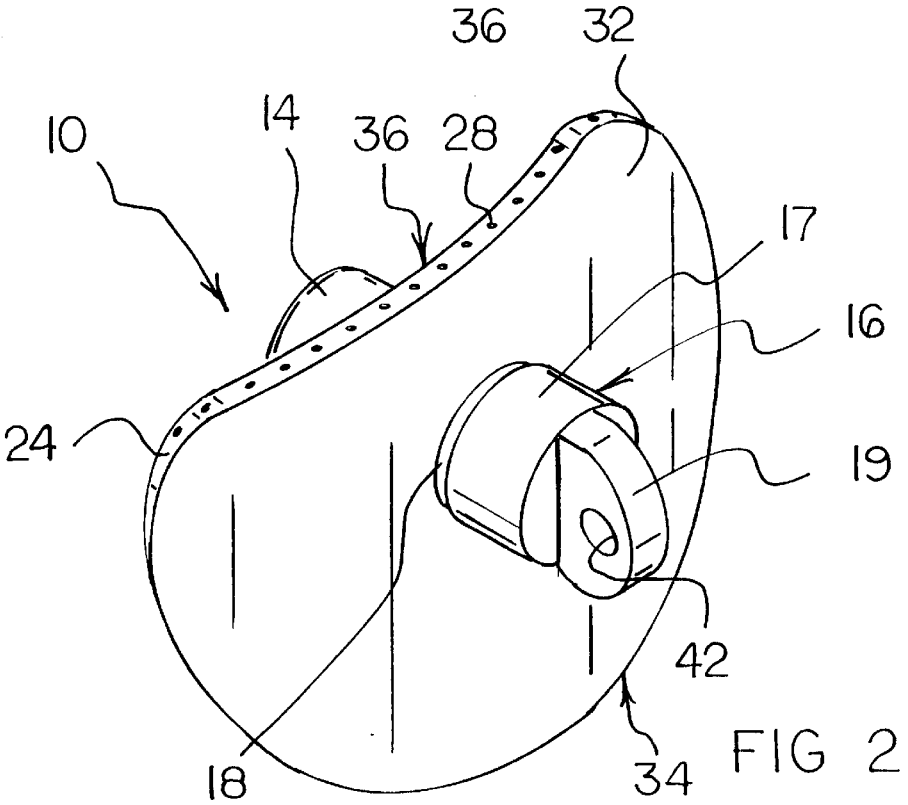
FIG. 2 is a bottom rear perspective view of the embodiment of the dispensing pacifier apparatus shown in FIG. 1.
Figure 3:
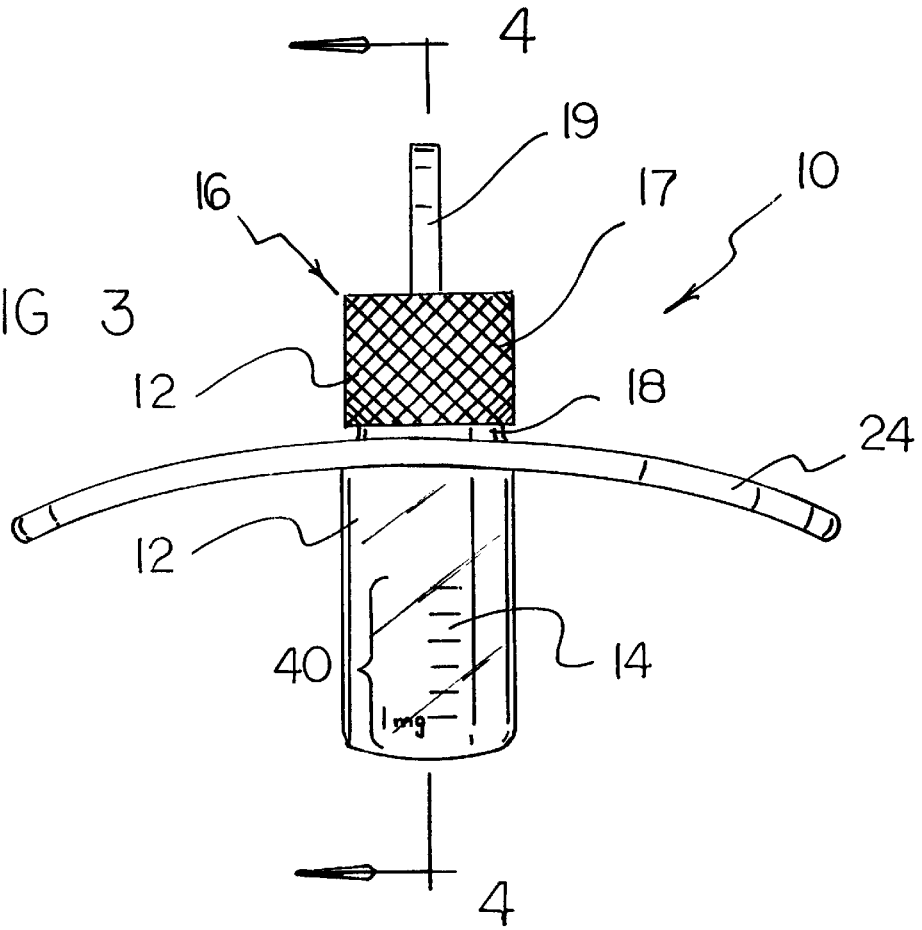
FIG. 3 is a top view of the embodiment of the dispensing pacifier apparatus of FIGS. 1 and 2.
Figure 4:
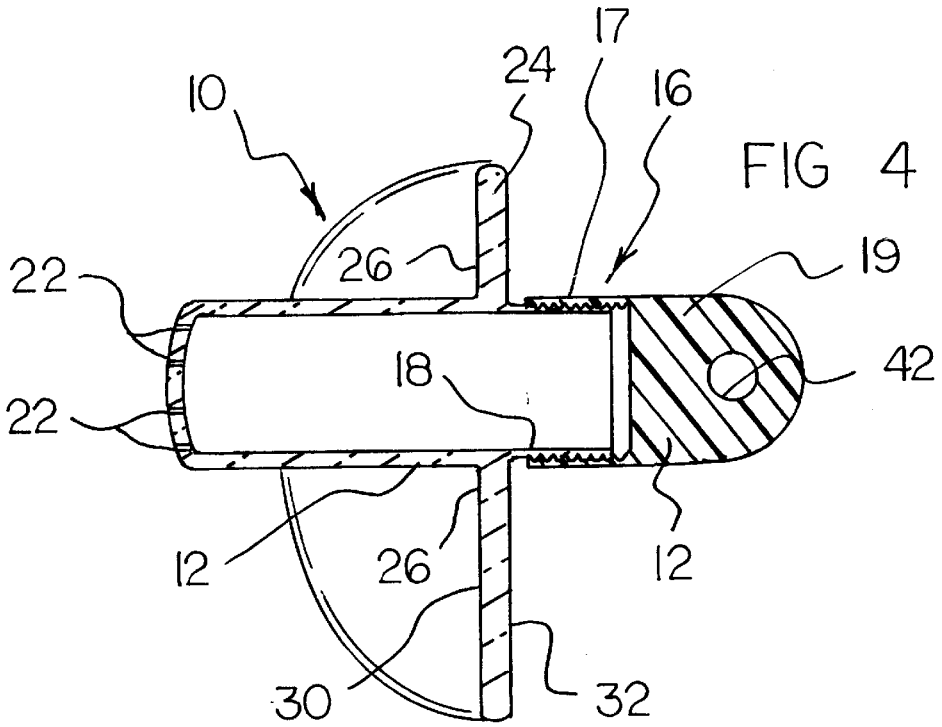
FIG. 4 is a cross-sectional view of a the embodiment of the invention shown in FIG. 3 taken along line 4—4 of FIG. 3.

Turning to FIGS. 1–4, there is shown an exemplary embodiment of the dispensing pacifier apparatus of the invention generally designated by reference numeral 10. In its preferred form, dispensing pacifier apparatus 10 includes a dispenser assembly 12 which includes a flexible container portion 14 and a screw cap assembly 16 which is removably connected to the flexible container portion 14. The flexible container portion 14 includes a loading end 18 and a dispensing end 20. The loading end 18 receives the screw cap assembly 16, and the dispensing end 20 includes one or more dispensing channels 22. The flexible container portion 14 is in the form of a nipple that an infant or toddler would suck on. A guard assembly 24 is connected to the dispenser assembly 12. The guard assembly 24 includes a perimeter portion 26 which surrounds the dispenser assembly 12. The guard assembly 24 is connected to the dispenser assembly 12 adjacent to the loading end 18 of the flexible container portion 14 in a position below the screw cap assembly 16. The guard assembly 24 includes a front side 30 and a rear side 32. The guard assembly 24 includes a plurality of saliva-absorbent apertures 28 located on the front side 30 of the guard assembly 24. The guard assembly 24 has a length and width that are greater than a mouth of an infant or toddler, whereby the dispensing pacifier apparatus 10 is prevented from being swallowed by the infant or toddler. The saliva-absorbent apertures 28 have a sufficiently small internal diameter to provide a capillary action for absorbing saliva The guard assembly 24 includes a top portion 34 and a bottom portion 36, and a greater density of saliva-absorbent apertures 28 are located on the bottom portion 36 than the top portion 34. Since a greater amount of saliva is generally found in regions on the guard assembly 24 below the flexible container portion 14, the greater density of saliva-absorbent apertures 28 are located on the guard assembly 24 below the flexible container portion 14 than above the flexible container portion 14.

The screw cap assembly 16 includes a cap 17 which is connected to the flexible container portion 14. The cap 17 is a child-proof cap. The screw cap assembly 16 includes an extension portion 19 which is connected to the cap 17. The extension portion 19 of the screw cap assembly 16 includes a connection aperture 42. The connection aperture 42 is suitable for attaching the dispensing pacifier apparatus 10 to a key ring or the like.

The flexible container portion 14 is made of transparent material so that material contained within the flexible container portion 14 is visible from outside the flexible container portion 14. The transparent material can be made of well known, flexible, transparent plastic materials such are conventionally used in dispensing pacifiers. The flexible container portion 14 includes indicia 40 indicative of volume of material inside the flexible container portion 14.

In using the dispensing pacifier apparatus 10 of the invention, the screw cap assembly 16 is removed from the flexible container portion 14, and a quantity of material (not shown) is placed in the flexible container portion 14. The screw cap assembly 16 is then replaced on the flexible container portion 14. Then, the flexible container portion 14 is offered to an infant or toddler. The infant or toddler places the flexible container portion 14 in one's mouth and can suck on the flexible container portion 14 in the same manner that the infant or toddler would suck on a nipple. As the infant or toddler sucks on the flexible container portion 14, portions of the material inside the flexible container portion 14 flow out from the dispensing channels 22 in the dispensing end 20 of the flexible container portion 14 into the mouth of the infant or toddler.

When the flexible container portion 14 is transparent, and the indicia 40 are present on the flexible container portion 14, an adult can remove the flexible container portion 14 from the mouth of the infant or toddler and learn the amount of material that remains in the flexible container portion 14 and can calculate the amount of material that has been dispensed from the flexible container portion 14.

To remove saliva that has been absorbed in the guard assembly 24 by the saliva-absorbent apertures 28, the guard assembly 24 is squeezed by an adult. It is understood that, if desired, channels may be provided between the guard assembly 24 and the flexible container portion 14 to recycle saliva back into the flexible container portion 14.

All of the components of the dispensing pacifier apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved dispensing pacifier apparatus that is low in cost, relatively simple in design and operation, and which may advantageously be used without using a simple friction fit for sealing the nipple portion of the pacifier. With the invention, a dispensing pacifier apparatus is provided which has a provision for absorbing saliva that flows from an infant's mouth as the infant uses the pacifier. With the invention, a dispensing pacifier apparatus is provided which has provisions for effectively retaining the saliva even when the pacifier is tilted or carried in a variety of orientations. With the invention, a dispensing pacifier apparatus is provided which prevents an infant from removing the cap from the dispenser. With the invention, a dispensing pacifier apparatus is provided which is provided with indicia which indicates the volume of material in the dispenser.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A dispensing pacifier apparatus, comprising:

a dispenser assembly which includes a flexible container portion and a screw cap assembly removably connected to said flexible container portion, wherein said flexible container portion includes a loading end and a dispensing end, wherein said loading end receives said screw cap assembly and said dispensing end includes one or more dispensing channels, and a guard assembly connected to said dispenser assembly, wherein said guard assembly includes a perimeter portion which surrounds said dispenser assembly, wherein said guard assembly is connected to said dispenser assembly adjacent to said loading end of said flexible container portion in a position below said screw cap assembly, wherein said guard assembly includes a front side and a rear side, wherein said guard assembly includes a plurality of saliva-absorbent apertures located on said front side of said guard assembly.

2. The apparatus of claim 1 wherein:

said guard assembly includes a top portion and a bottom portion, and a greater density of saliva-absorbent apertures are located on said bottom portion than said top portion.

3. The apparatus of claim 1 wherein said screw cap assembly includes a cap which is connected to said flexible container portion.

4. The apparatus of claim 3 wherein said cap is a child-proof cap.

5. The apparatus of claim 1 wherein said screw cap assembly includes an extension portion connected to said cap.

6. The apparatus of claim 5 wherein said extension portion of said screw cap assembly includes a connection aperture.

7. The apparatus of claim 1 wherein said flexible container portion is made of transparent material so that material contained within said flexible container portion is visible from outside said flexible container portion.

8. The apparatus of claim 7 wherein said transparent flexible container portion includes indicia indicative of volume of material inside said flexible container portion.

* * * * *